US005087327A

United States Patent [19]

Hood

[11] Patent Number: 5,087,327

[45] Date of Patent: Feb. 11, 1992

[54] PMC YARN WITH SOLUBLE MONOFILAMENT CORE

[75] Inventor: Paul F. Hood, Glenmont, N.Y.

[73] Assignee: Albany International Corp., Albany, N.Y.

[21] Appl. No.: 549,744

[22] Filed: Jul. 9, 1990

[51] Int. Cl.[5] ..... D21F 3/00

[52] U.S. Cl. ..... 162/358; 139/383 A; 162/DIG. 1; 428/225; 428/257; 428/280; 428/282; 428/300; 428/373; 428/377; 428/234

[58] Field of Search ..... 139/383 A; 162/DIG. 1, 162/348, 358; 428/225, 257, 258, 259, 253, 377, 234, 300, 182, 280, 373

[56] References Cited

U.S. PATENT DOCUMENTS 4,093,512 6/1978 Fleischer ..... 428/259
4,283,454 8/1981 Buchanan ..... 428/259
4,433,493 2/1984 Poisson ..... 428/258
4,489,125 12/1984 Gagnon ..... 428/235
4,533,594 8/1985 Buchanan ..... 428/258

*Primary Examiner*—James J. Bell
*Attorney, Agent, or Firm*—Kane, Dalsimer, Sullivan, Kurucz, Levy, Eisele and Richard

[57] ABSTRACT

A composite yarn for use in a papermaker's fabric, for the press section of a papermaking or similar machine, is disclosed. The composite yarn includes a core substantially surrounded by a layer of monofilament. The core is at least partially soluble. On the other hand, the monofilament layer is non-soluble and is either braided, knitted, or helically wound around the core. After the base fabric, woven from the composite yarns, has been needled, the soluble portion of the core is washed out, supplying an increase in void volume to the finished fabric.

16 Claims, 2 Drawing Sheets

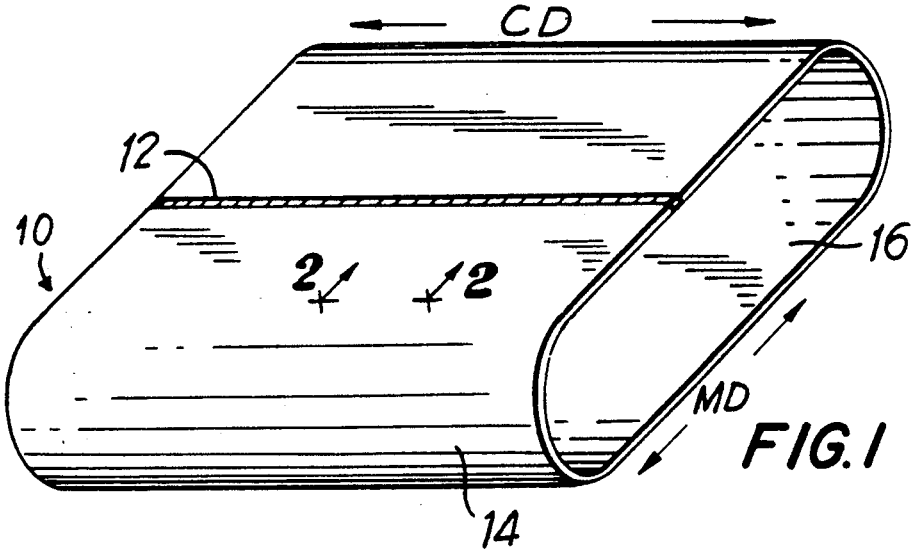
FIG. 1
FIG. 2a
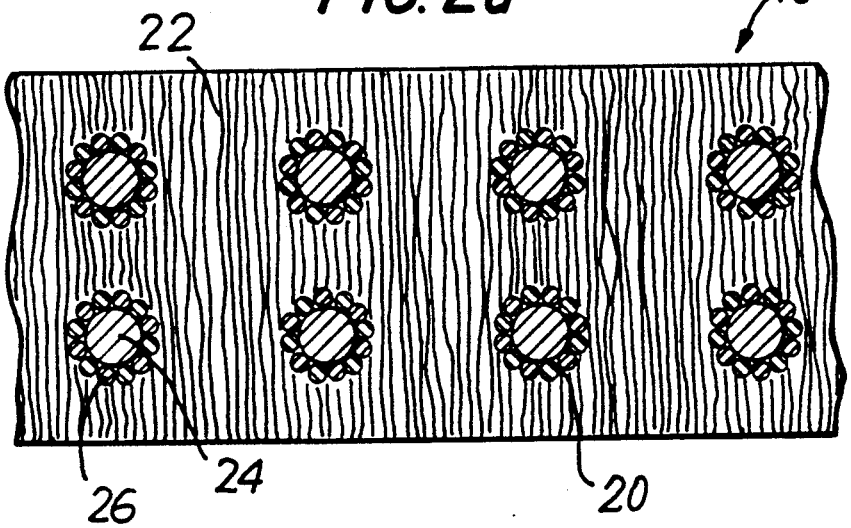
FIG. 2b
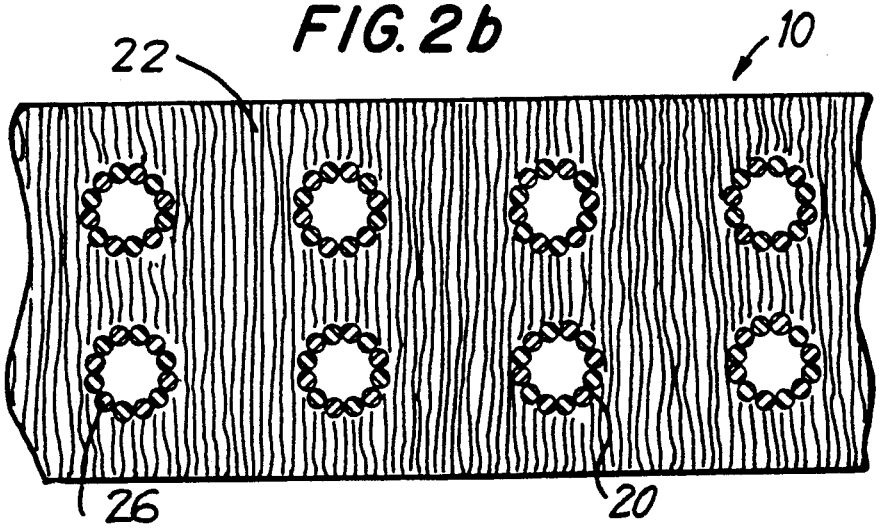

FIG. 3a
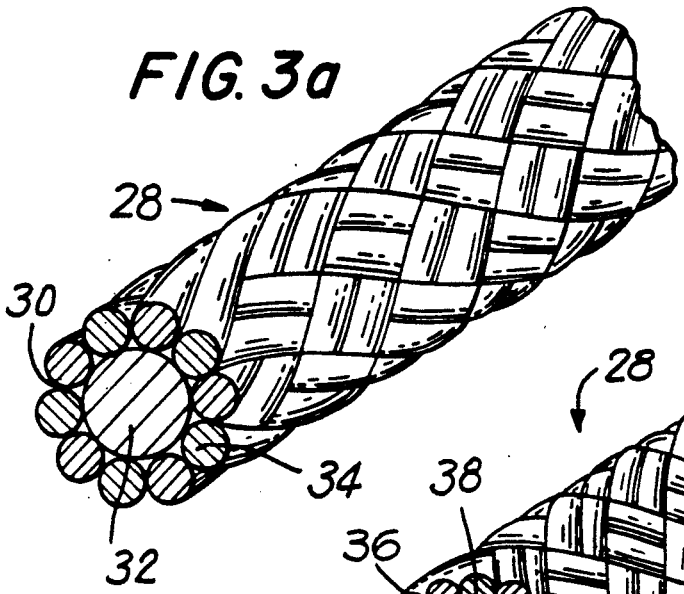
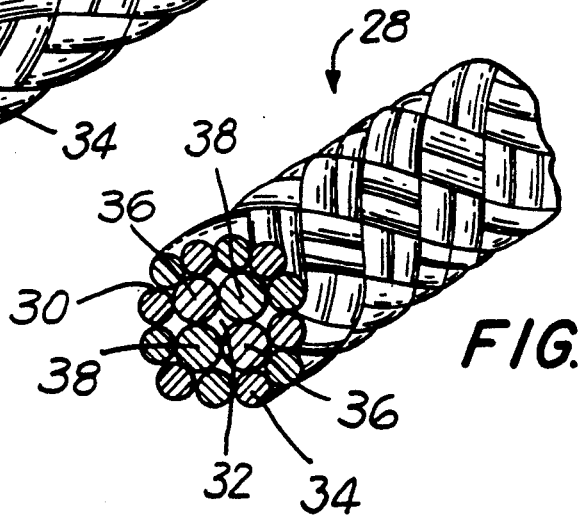
FIG. 3b
FIG. 4a
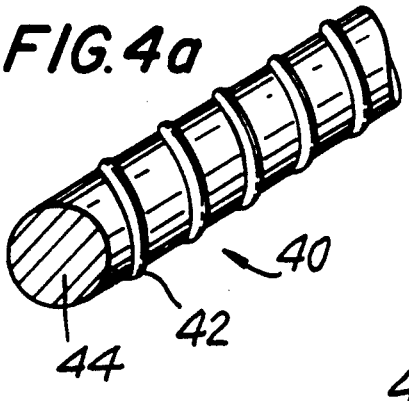
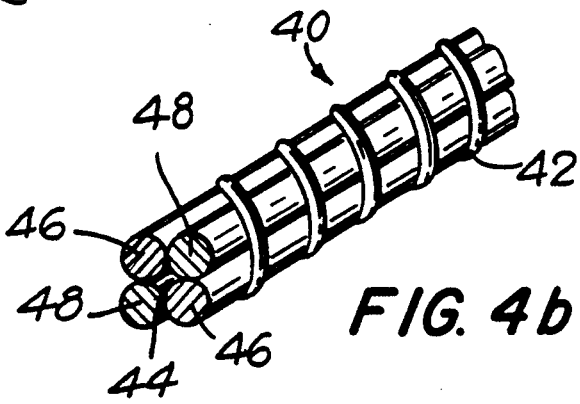
FIG. 4b

PMC YARN WITH SOLUBLE MONOFILAMENT CORE

BACKGROUND OF THE INVENTION

1. Field of the Invention

The subject invention relates to the press fabrics used to clothe the press sections of papermaking and similar machines. It more specifically relates to the use of special composite yarns having soluble cores in the weaving of these fabrics in order to provide them with increased void volume and longitudinal extensibility, and lower mark tendency.

2. Description of the Prior Art

The press fabrics used to clothe the press sections of papermaking machines are crucial components in the paper manufacturing process. One of their functions is to support and carry the paper product being manufactured through the presses which act by means of compression to force or squeeze water from the wet paper sheet. In this respect, the fabric serves as a conveyor belt during the manufacturing process.

The press fabrics also serve the function of finishing the surface of the paper sheet. That is, the surface of the press fabric is designed to be smooth and uniformly resilient so that, in the course of passing through the presses, a smooth, mark-free surface is imparted to the paper.

Perhaps most importantly, the press fabrics accept the large quantities of water pressed from the wet paper. In order to fill this function, there literally must be somewhere for the water to go within the body of the fabric. Accordingly, a successful press fabric design provides both a certain amount of void volume, for the temporary storage of water, and channels or pathways between the strands of yarn from which it is woven. These will allow water to pass through the fabric from the sheet-carrying side to the other side and, in the vicinity of the press nip, to flow longitudinally through the fabric away from the nip.

Contemporary press fabrics are available in a wide variety of styles designed to meet the requirements of the papermachines on which they are installed for the paper grades being manufactured thereon. Generally, they comprise a woven base fabric into which has been needled a batt of fine, nonwoven fibrous material. The base fabrics can be woven from monofilament, plied monofilament, multifilament, and like yarns and can be single-or multi-layered. Typically, the spaces between machine-direction (MD) and cross-machine direction (CD) yarns are intended to provide the requisite channels for water to flow in the plane of the fabric, and perpendicularly through the fabric, as well as to make up void volume for the temporary storage of water.

After the base fabric has been woven, the batt is needled into the fabric structure. This provides the finished fabric with a smooth, even surface very much like that of the original press felts woven from wool. As a consequence of the needling process, some batt fibers extend perpendicularly through the plane of the fabric. These fibers, and the voids formed between them, will generally allow water, pressed from the wet paper sheet in the press nip, to pass through the body of the fabric and away from the paper.

An undesirable effect of the needling process is the filling of much of the void volume within the base fabric. This makes the finished press fabric to some extent less capable of filling the functions for which it has been designed. In addition, this reduced void volume will fill more quickly with trapped wood fiber and fine particles, both of which will make the fabric less permeable to water. As a consequence, press fabric life on the papermachine will be shorter than desirable.

The present invention provides a solution for this problem by permitting the re-introduction of void volume after the needling process has been completed by removing soluble material which forms at least part of the core of the composite yarns used in the weaving of the base fabric.

SUMMARY OF THE INVENTION

In accordance with the present invention, one includes in the weave of a papermaker's fabric, particularly one designed for use on the press section of a papermachine, a composite papermachine clothing (PMC) yarn which includes a core surrounded by an outer layer. The core may include monofilament, multifilament, or any combination thereof, yarns. The distinguishing feature of the present invention is that the core of the composite yarns includes soluble yarns, which are removed through the use of an appropriate solvent after the weaving of the papermaker's fabric. In contrast, the outer layer surrounding the core of the composite yarns is nonsoluble, and may include yarns which are knitted, braided, or helically wound around the core.

Accordingly, the present invention is a composite PMC yarn, which includes both soluble and non-soluble components, for use in weaving the base fabrics for papermachine clothing. In particular, the soluble components of the composite PMC yarns are found in the cores thereof, while the outer layers of the composite yarns are non-soluble. The cores may include both soluble and non-soluble components, or may be completely soluble.

The reason for the soluble core is that, following the weaving process, the batt of fibrous material is needled into the structure of the fabric. As noted above, much of the void volume of the base fabric will be taken up by these fibers. However, void volume, equal to that occupied by the soluble component of the core of the composite yarn, is recovered by washing out or dissolving the soluble component. In this manner, the use of a soluble material allows one to ensure that the final fabric will have sufficient void volume to enable it to efficiently perform its function on the papermachine in spite of the tendency of the needling process to restrict void volume.

The PMC yarns for the present invention have several different embodiments to be described further in the discussion to follow. Regardless of the specific embodiment however, these PMC yarns provide several distinct advantages associated with their structure.

Once the soluble material has been washed out of the finished fabric, there will be provided channels, through the cores of the yarns, lying in the plane of the fabric and oriented in the longitudinal and transverse directions. This provides pathways for the flow of water longitudinally and transversely within the fabric in the vicinity of the nip.

When a given length of the press fabric, carrying a wet paper sheet, approaches a press nip, the water within the fabric will suddenly experience a great increase in pressure. In response to this increased pressure, it will flow from the sheet to and into the press fabric. The channels provided in the fabric through the yarn cores after the removal of the soluble component thereof allow the water to freely do so, and spare the wet paper sheet from potential damage, such as crushing. In a similar fashion, when a given length of the press fabric passes through the nip, water in the fabric is forced by the increased pressure in the direction of fabric motion through the same channels.

Other benefits of the present invention, as well as the forms taken by different embodiments of the PMC yarn, will be discussed below in greater detail with reference to the accompanying figures.

BRIEF DESCRIPTION OF THE DRAWINGS

FIG. 1 is a perspective view of a press fabric for a papermachine which can include the PMC yarns of the present invention.

FIG. 2*a* is an enlarged cross-sectional view of the papermachine fabric shown in FIG. 1. FIG. 2*a* is the view taken as indicated in FIG. 1 before the soluble core material of the composite PMC yarns has been washed out. FIG. 2*b* is the same view taken after the soluble core has been removed.

FIGS. 3*a* and 3*b* show two embodiments of the composite PMC yarns wherein a layer of non-soluble monofilaments surrounds a monofilament core.

FIGS. 4*a* and 4*b* show two further embodiments of the composite PMC yarns wherein non-soluble monofilaments are twisted in a helical or spiral fashion around a monofilament core.

DESCRIPTION OF THE PREFERRED EMBODIMENTS

With reference now to the accompanying figures, a perspective view of a press fabric 10 for a papermachine is shown in FIG. 1. The press fabric 10 shown is of the variety that is closed into endless form by means of the seam 12 when said press fabric 10 is being installed on the papermachine. However, the bases for press fabrics can also be woven in endless form. When such is the case, the press fabric 10 will neither have nor require a seam 12. The PMC yarns of the present invention can be used to weave the bases for press fabric 10 of either the seamed or "woven endless" varieties.

As shown in FIG. 1, the press fabric 10 has an outer surface 14 and an inner surface 16. The outer surface 14 is that which actually comes into contact with the wet fibrous paper sheet being processed. The inner surface 16, on the other hand, contacts machine components, such as press rolls and fabric support rolls, as the machine operates. During paper production, some water is pressed into and through the press fabric 10 from the outer surface 14, where it is pressed from the wet fibrous sheet, to the inner surface 16, and through that surface to a vented press roll. Another quantity of water is temporarily stored in the voids of the fabric structure. This latter quantity of water is usually removed by a device called a suction box.

For the sake of completeness, the machine direction and the cross-machine direction are indicated in FIG. 1 by the labels "MD" and "CD" respectively. By convention, these designations refer to the corresponding directions of the papermachine on which the press fabric 10 is installed.

FIGS. 2*a* and 2*b* represent, on a greatly enlarged scale, the section view of the press fabric 10 taken as indicated in FIG. 1. According to FIGS. 2*a* and 2*b*, the views shown are taken in the cross-machine direction. As such, the observer of both figures sees the MD yarns 20 of the press fabric 10 in cross section. CD yarns, while generally present in the press fabric 10, are not shown in the figures for the sake of clarity.

In both FIGS. 2*a* and 2*b*, a batt 22 of fibrous material is shown as it would appear after being needled into the base of the press fabric 10 according to techniques conventionally applied in the industry. As can be most clearly seen in FIG. 2*a*, the batt 22 occupies the space between the MD yarns 22 and the CD yarns, not shown, severely limiting the void volume available for water. Further, the reduction of available void volume increases the likelihood that wood fiber and other fine particles from the sheets being processed into paper will become trapped therein and unduly restrict the permeability of the press fabric 10. In the end, the useful life of the press fabric 10 will be shortened.

Turning particularly now to FIG. 2*a*, the MD yarns 20, seen in cross section, take the form of the composite PMC yarns of the present invention. In the particular embodiment of the PMC yarns shown, a monofilament core 24 of soluble material, such as polyox, (polyethylene oxide), which is soluble in water, is surrounded by a braided or knitted layer of non-soluble monofilaments 26. The view shown in FIG. 2*a* represents the condition of the press fabric 10 before the washing which will remove the monofilament core 24 of soluble material has been performed. After the washing of the press fabric 10, it will assume the appearance represented by FIG. 2*b*, which differs from FIG. 2*a* by the absence of the monofilament cores 24 of soluble material in each of the MD yarns 20. The removal of this material in the washing process restores additional void volume to the interior of the press fabric !0 for the storage of water. Further, in the embodiment shown, the resulting tubular configuration of the MD yarns 20 provides longitudinal channels in the body of the press fabric 10 which can serve to conduct water away from the press nip in longitudinal directions to relieve water pressure build-up which can damage the still delicate wet paper sheets. Of additional benefit is the characteristic resilience of the now-hollow and tubular MD yarns 20. This enables the yarns to bear the compression within the nip, yet quickly spring back to original form when this pressure is removed.

Several embodiments of the PMC yarns will now be described in further detail. FIGS. 3*a* and 3*b* each show strands 28 of PMC yarn which include a layer 30 surrounding a core 32. In each of FIGS. 3*a* and 3*b*, the outer layer 30 is made of nonsoluble monofilaments 34, intertwined by braiding or knitting around the core 32.

In FIG. 3*a*, the core 32 is a monofilament of a soluble material, such as polyox. In the washing process, this core 32 is completely removed. In FIG. 3*b*, however, the core 32 has both soluble monofilaments 36 and non-soluble monofilaments 38. Following washing, the non-soluble monofilaments 38 will remain in the core 32 to provide added strength to the strand 28 as might be required by a particular papermachine fabric application. Alternatively, the core 32 may be a soluble multifilament or spun yarn, or may be a yarn of either of these types having both soluble and non-soluble filaments or fibers.

FIGS. 4*a* and 4*b* show embodiments of a different variety. In each of these figures, the strand 40 is produced by twisting a non-soluble monofilament 42 around a core 44 in a helical or spiral fashion. the non-soluble monofilament 42 is not a true spiral, however, since, if unravelled from around the core 44, it would be a straight monofilament once more. In other words, the non-soluble monofilament 42 does not naturally have the shape of a spiral or helix; rather it acquires such a shape by reason of its being twisted around the core 44.

As was noted above in the discussion of FIGS. 3*a* and 3*b*, the core 44 in FIGS. 4*a* and 4*b* can be either single or composite. That is, in FIG. 4*a*, the core 44 is a single strand of soluble monofilament. In FIG. 4*b*, the core 44 includes both soluble monofilament 46 and non-soluble monofilament 48. As before, the embodiment of FIG. 4*b* would be a PMC yarn of strength greater than that of the embodiment of FIG. 4*a* after the removal of the soluble component of the core 44. Also as before, the core 44 may be a soluble multifilament or spun yarn, or may be a yarn of either of these types having both soluble and non-soluble filaments or fibers.

In general, the benefits of the PMC yarns of the present invention are that they provide increased void volume within the press fabrics in which they are incorporated. The yarns also have greater longitudinal extensibility by reason of their twisted, braided, or knitted, rather than straight orientations. Finally, their use permits the production of press fabrics having a reduced tendency to mark the paper sheet being produced. This is because the yarns have a greater ability to flatten in response to compression perpendicular to the plane of the fabric to provide a smooth, even surface and a greater ability to spring back to original shape when the compression is removed.

For example, use of a large number of these yarns in the top layer of a two- or three- layered base fabric will reduce base mark in the paper sheet. Since the yarn will "flatten" to some degree under pressure, its dimensional cross section presented to the paper sheet under compression in the press nip will be greater. Consequently, the applied pressure will be more uniformly distributed to the paper sheet. With proper selection of materials, one can maintain this property for an extended period of the fabric life. On the other hand, yarns could be designed to rapidly compact and produce a pseudo single-layered base for use in seamed press fabrics for board making positions.

When one wraps or twists a soluble monofilament with another yarn, the yarn will appear to have a slight coil spring appearance in the base after the fabric is finished. This spring provides several running benefits to the fabric, such as an increased extensibility for multi-nip positions, better energy absorption in the nip due to a more resilient base, and the previously noted increase in void volume and water handling capability.

With reference to the dimensions of the composite yarns of the present invention, the diameters of the individual monofilament components thereof may be anywhere in the range from 0.10 mm to 0.40 mm, but preferably lie in the range form 0.10 mm to 0.20 mm. The diameters of the composite yarns would depend upon the number of strands used, as well as upon the "tightness" of the braid, knit, or helix. A representative diameter would be 0.70 mm, but could take on greater values in view of the openness, ability to flatten, and resiliency of the present composite yarns.

The soluble component of the core of the yarns of the present invention may be produced from a variety of materials. Polyox (polyethylene oxide), polyvinyl alcohol, and calcium alginate can be used to produce yarns which are soluble in water. In addition, "soft" acrylics, which are very soluble in warm water, are also quite suitable.

With reference to the use of acrylics for this purpose, an acrylic film can be cast, dried, cured, and slit into narrow widths to form a monofilament yarn in dimensions similar to those of extruded monofilaments. The "monofilaments" produced in this manner may then be used as the soluble component of the composite PMC yarns of the present invention. An example of a suitable acrylic is one of any of the family of Hycar resins supplied by B. F. Goodrich.

Other substances from which the soluble component of the core of the yarns of the present invention may be made are those which are soluble in a weak acid solution, having a pH in the range from 4.0 to 7.0, or those which are soluble in a week basic or alkaline solution, having a pH in the range from 7.0 to 9.0. Other substances, soluble in organic solvent, may find use.

Examples of these materials include alkyl starch, which is soluble in organic solvents, such as alcohols or acetic acids. Another substance is methocel, or methylcellulose, which is soluble in alkaline environments. Still another example is hydroxymethyl cellulose, which is a water-soluble material, whose solubility is greatly enhanced in weak acidic solutions. Finally, a 65% methylmethacrylate/35% methacrylate copolymer is soluble in sodium hydroxide, an alkaline solution. All of these materials may be made into "monofilaments" by the "film" method described above for doing so for acrylics.

Modifications to the present invention would be obvious to those skilled in the arts to which it is applied without departing from the scope of the appended claims.

What is claimed is:

1. In a papermaker's fabric designed for use on the press section of a papermaking or similar machine, said papermaker's fabric being woven from yarns in longitudinal, or machine, and transverse, or cross-machine, directions, the improvement comprising:

a composite yarn in one of said longitudinal or transverse directions, said composite yarn having a core and a monofilament layer, said monofilament layer substantially surrounding said core, wherein said core includes at least one strand of a soluble material.

2. In a papermaker's fabric as improved in accordance with claim 1, a composite yarn wherein said monofilament layer includes non-soluble monofilament strands braided about said core.

3. In a papermaker's fabric as improved in accordance with claim 1, a composite yarn wherein said monofilament layer comprises non-soluble monofilament strands knitted about said core.

4. In a papermaker's fabric as improved in accordance with claim 1, a composite yarn wherein said monofilament layer comprises at least one non-soluble monofilament strand helically wound around said core.

5. In a papermaker's fabric as improved in accordance with claim 1, a composite yarn wherein said core comprises a monofilament strand of a soluble material.

6. In a papermaker's fabric as improved in accordance with claim 1, a composite yarn wherein said core comprises a plurality of multifilament strands of a soluble material.

7. In a papermaker's fabric as improved in accordance with claim 1, a composite yarn wherein said core comprises a plurality of monofilament strands, at least one of said monofilament strands being of a soluble material.

8. In a papermaker's fabric as improved in accordance with claim 1, a composite yarn wherein said core comprises a plurality of multifilament stands at least one of said multifilament strands being of a soluble material.

9. In a papermaker's fabric as improved in accordance with claim 1, a composite yarn wherein said soluble material may be dissolved in water.

10. In a papermaker's fabric as improved in accordance with claim 9, a composite yarn wherein said soluble material is selected from a group consisting of polyethylene oxide, polyvinyl alcohol, calcium alginate, soft acrylic, and hydroxymethyl cellulose.

11. In a papermaker's fabric as improved in accordance with claim 1, a composite yarn wherein said soluble material may be dissolved in a weak acidic solution having a pH in the range from 4.0 to 7.0.

12. In a papermaker's fabric as improved in accordance with claim 11, a composite yarn wherein said soluble material is hydroxymethyl cellulose.

13. In a papermaker's fabric as improved in accordance with claim 1, a composite yarn wherein said soluble material may be dissolved in a weak alkaline solution having a pH in the range from 7.0 to 9.0.

14. In a papermaker's fabric as improved in accordance with claim 13, a composite yarn wherein said soluble material is selected from a group consisting of methylcellulose and a 65% methylmethacrylate/35% methacrylate copolymer.

15. In a papermaker's fabric as improved in accordance with claim 1, a composite yarn wherein said soluble material may be dissolved in an organic solvent.

16. In a papermaker's fabric as improved in accordance with claim 15, a composite yarn wherein said soluble material is alkyl starch.

* * * * *